United States Patent [19]

Habeck et al.

[11] Patent Number: 4,510,871

[45] Date of Patent: Apr. 16, 1985

[54] RAILROAD VEHICLE BOGIE

[75] Inventors: Reinhold Habeck, Eichenau; Norbert Mackiol; Franz Mautner, both of Munich; Peter Schwärzler, Fürstenfeldbruck, all of Fed. Rep. of Germany

[73] Assignee: Krauss-Maffei Aktiengesellschaft, Munich, Fed. Rep. of Germany

[21] Appl. No.: 376,245

[22] Filed: May 7, 1982

[30] Foreign Application Priority Data

May 15, 1981 [DE] Fed. Rep. of Germany ..... 3119332
Mar. 6, 1982 [DE] Fed. Rep. of Germany ..... 3208168

[51] Int. Cl.[3] ..... B61F 3/08; B61F 5/30; B61F 5/46

[52] U.S. Cl. ..... 105/167; 105/171; 105/218 R; 105/222; 105/223; 105/224 R

[58] Field of Search ..... 105/165, 167, 169, 171, 105/175, 182 R, 218 R, 218 A, 222, 223, 224 R, 224.1

[56] References Cited

U.S. PATENT DOCUMENTS 1,822,955 1/1932 Anderson ..... 105/175 R
3,228,349 1/1966 Akitt et al. ..... 105/175 R

FOREIGN PATENT DOCUMENTS 917676 9/1954 Fed. Rep. of Germany ..... 105/169
2029329 1/1972 Fed. Rep. of Germany ... 105/224 R
2419889 11/1975 Fed. Rep. of Germany ..... 105/222
2458101 8/1979 Fed. Rep. of Germany ..... 105/169
825955 12/1937 France ..... 105/218 R

OTHER PUBLICATIONS

German Laid-Open Application K 11 385 II/20d.

*Primary Examiner*—David A. Scherbel
*Assistant Examiner*—Howard Beltran
*Attorney, Agent, or Firm*—Karl F. Ross; Herbert Dubno

[57] ABSTRACT

A bogie for a railroad vehicle comprises a pair of wheel sets mounted in a frame which is pivotally connected to the vehicle so that it can rotate about a substantially upright axis. The wheel sets are connected to the frame resiliently and by links which, upon the application of unbalanced force, axially to one of the wheel sets shifts the force-receiving end toward the other wheel set. The links can also be disposed so that any tendency for one of the wheel sets to move downwardly relative to the frame will result in a tendency for it also to move closer to the other wheel set. This has been found to increase high speed stability of the vehicle.

6 Claims, 5 Drawing Figures

RAILROAD VEHICLE BOGIE

FIELD OF THE INVENTION

The present invention relates to a bogie for railroad vehicles and, more particularly, to a wheel truck for railway cars having at least two sets of wheels, each set provided with a respective axle, the bogie or truck carriage being pivotal relative to the vehicle body about an upright axis.

BACKGROUND OF THE INVENTION

In the undercarriages of railway vehicles it is common to provide bogies or trucks which can be pivotal about an upright axis relative to the vehicle body or chassis; each bogie can carry a pair of axles, each axle having a pair of wheels adapted to run upon the track on respective rails. The two wheels and the common axle can form a wheel set.

Thus bogies or trucks which have at least two wheel sets, which can be resiliently suspended in the bogie or truck, can be provided in such fashion as to permit axial displacement of the wheel sets within the bogie or truck frame to facilitate pivoting of the bogie on the vehicle.

Such bogies or trucks are disclosed, for example, in German patent documents (open applications) Nos. 20 29 329 and 24 19 989.

While these systems have been found to be significant improvements over earlier arrangements in which some axial or transverse movement of the wheel sets in the bogie frames was not permitted, they have not hitherto been capable of satisfactorily ensuring high stability on railway straightaways and turns at high speeds, for example 150 km per hour and more, especially 250 km per hour and up.

OBJECT OF THE INVENTION

It is the principal object of the invention to provide a railway bogie or truck which is capable of overcoming the disadvantages of earlier systems and affords high stability for railway vehicles operating at speeds in excess of 150 km per hour and even in excess of 250 km per hour.

SUMMARY OF THE INVENTION

These objects and others which will become apparent hereinafter are attained, in accordance with the invention, in a railway bogie or truck of the type described, i.e. having a bogie or truck frame which is pivotal relative to the vehicle body about the upright axis and which receives two wheel sets spaced apart on opposite sides of the upright axis and axially shiftable in the bogie frame, and resilient means acting upon the wheel sets or biasing them into mutually parallel relationship against dislocating forces, guide structure being provided according to the instant invention so that, upon such dislocation or the development of forces in the axial direction upon the wheel tending to bring about transverse dislocation (with respect to the direction of travel of the vehicle), each wheel set is guided such that an inward force on a wheel of the respective set will result in a displacement of this wheel in the direction of the other set and the opposite wheel of the set subject to such displacement, away from the other set.

Thus each set can comprise a pair of wheels and, in turn, one of the wheels of each pair will lie along the inside of the turn and will be subjected to inward axial displacement while the other wheel in each pair will lie along the outside of the turn.

The inwardly axially displaced wheel of each pair is thus guided toward the other wheel set whereas the other wheel of the pair is guided in a direction away from the other wheel set.

It has been found, quite surprisingly, that this arrangement, especially when provided for both wheel sets of each bogie, results in a uniform movement of the vehicle along the track even at extremely high speeds and for straightaways as well as for curved stretches.

In the past, pivotal movement of the bogie relative to the vehicle body or chassis has been assumed to be sufficient to enable the wheels to follow the track and thus provide for stability. Subsequently it was discovered that a rigid positioning of the wheel sets in the bogie did not allow the wheel sets to compensate for the arcuate pattern of movement required on curves. Hence the systems proposed in the aforementioned open applications whereby the individual wheel sets can adjust their positions in the respective bogies to suit the curved path of the railway car.

Now it has been found that, whereas the compensatory movement of these earlier systems did provide for an improved ability to compensate for curves, the insufficiency of these earlier systems on high speed particularly, especially with respect to straightaways, can be compensated by a unique approach to the guidance of the wheel sets whereby, instead of allowing them to freely shift within the bogie, on a turn, they are constrained to move in opposite (mirror-symmetrical) patterns such that the wheels to which inward forces are applied tend to be shifted toward one another while the other wheels of the two sets tend to be shifted away from one another.

According to a feature of the invention, such guidance of the wheel sets can be effected by pairs of links which, rather than constituting parallelogrammatic linkages, are of the configuration of trapezoids, the trapezoidal pattern on one side of each wheel set converging toward the axis thereof and, on the opposite side, converging away from the axis. For the bogie as a whole, therefore, the trapezoidal linkage proximal to the upright axis about which the bogie can pivot can converge away from a vertical median plane of the bogie.

Each wheel set is thus associated with two trapezoidal linkages, including one having a broad base proximal to the pivot axis of the bogie and the short base at the axle of the respective wheel set, and a second having its broad base at the axle of the wheel set and its small base fixed to the bogie frame remote from the upright pivot axis.

In general, therefore, the longer base of the trapezoidal linkage can lie in the region of the frame when the linkage is disposed between the wheel sets, while the long base can lie in the region of the respective axles when the trapezoidal linkage lies outside the wheel set.

While one trapezoidal linkage is all that is required for each wheel set of each bogie, it has been found that best results are obtained when two such linkages are provided for each wheel set under the conditions set forth, each of the trapezoidal linkages forming an isosceles trapezoid. The pivots at the vertices of the trapezoidal linkages may be formed by pins, bolts, eyes and the like and in each of the trapezoidal linkages may lie in a common horizontal plane.

In one embodiment of the invention, when two or more linkages are provided for each set, both linkages are coplanar.

In another embodiment of the invention, the trapezoidal linkages of a particular bogie or of a particular wheel set may be offset vertically from one another, i.e. the pivots may lie in two different horizontal planes, vertically offset from one another.

The pivots may include pins received in elastomeric sleeves and forming so-called "silentblock" resilient bearings or pivots. The angle between the arms of the trapezoidal linkage and perpendiculars to the long bases in the normal positions of the wheel sets can range between 5° and 15°.

According to yet another feature of the invention the links between the frame and each set of wheels may comprise pairs of link members pivotally connected at their respective ends to the frame and to the wheel set. It has been found that particularly advantageous results can be obtained when the pivot point of the linkage is located outwardly of the wheel sets, i.e. between the wheel sets and the outer limbs of the frame, are pivotally secured at the same level or a lower level than the pivots between these links and the bearings of the respective wheel sets while the pivot points of the links lodge inwardly of the wheel sets, i.e. between each wheel set and an inner limb of the frame, are at the same level or above the pivots between these links and the bearings of the wheel sets.

This ensures that, as each wheel set moves downwardly, it will approach the other wheel set and that when each wheel set moves upwardly it is moved away from the other wheel set.

Preferably, in accordance with these features, the pivot points for each link are vertically offset from one another and the upper pivots lie in one horizontal plane while the lower pivots lie in another horizontal plane and all of the pivots to the frame lie at a level intermediate to these two planes whereby, with respect to a horizontal plane, the length and the wheel sets are mirror-symmetrical and that this mirror-symmetry can also apply to a vertical plane through the pivoting axis of the bogie parallel to the axis of the wheels.

The links in this latter embodiment can be inclined at angles of up to 20° to the horizontal plane.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
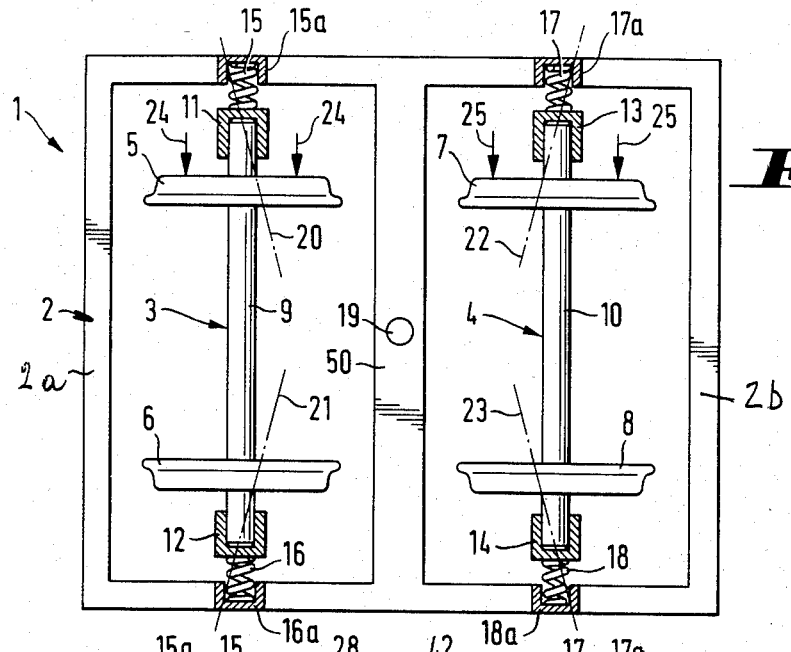
FIG. 1 is a plan view, partly broken away, through a railroad bogie of the present invention in which the guides for the wheel sets have not been shown, although the direction of movement has been illustrated.

In FIG. 1 of the drawing there is shown a bogie or truck carriage 1 which comprises a frame 2 having a pair of transoms or outer limbs *2a, 2b* disposed outwardly of a bolster or central bar or inner limb 50.

Within the frame, two wheel pairs or sets 3 and 4 are independently mounted, these sets having rail-engaging wheels 5, 6 and 7, 8, respectively.

The wheels 5, 6 are mounted upon a shaft or axle 9 and the wheels 7, 8, are mounted upon a shaft or axle 10, the respective shafts forming part of the respective wheels sets.

The axle 9 is journaled in a pair of bearings 11, 12 while the axle 10 is journaled in a pair of bearings 13, 14, the bearings being shown highly diagrammatically.

In fact, the suspension details for the bearings have not been illustrated in FIG. 1 but each bearing is shown to be resiliently supported, e.g. via springs 15, 16, 17, 18, so as to be capable of some axial displacement in the bearing supports 15*a*, 16*a*, 17*a* and 18*a*.

The normal or basic positions of the wheel sets are shown in FIG. 1.

The guide structure supporting the axle bearings 11, 12, 13, 14 are constructed and arranged so that the end points of the axles 9 and 10 can move along paths represented by the dot-dash lines 20–23 when the truck or bogie negotiates a curve on the rails, the bogie or carriage being pivotable about a pivot pin or axis 19 which is upright (vertical) and connects the bogie or truck 1 with the railroad vehicle body.

The movement of the end points of the axles 9 and 10 along the paths represented in the dot-dash lines at 20, 21, 22, 23 is effected upon the application of unbalanced axial forces to the sets of wheels. For example, if a net axial force resulting from negotiation of the curve is applied in the direction of arrows 24 and 25, the upper end of the wheel set 3 will shift downwardly and to the right, i.e. toward the other wheel set 4 whereas the bottom end of the wheel set 3 will move downwardly and to the left along the path 21 and away from this other wheel set 4.

Consequently, the pattern of movement corresponds to a clockwise rotation of the wheel set 3 and a counterclockwise rotation of the wheel set 4 with centers of curvature corresponding to the centers of circles for which the paths 20, 21 and 22, 23 are respective tangents.

If it is assumed that these forces 24 and 25 are the result of a sinusoidal running of the wheels 5 and 7 along the rails over straight stretches of the latter, the swingable wheel set arrangement provides a guidance which compensates for these forces with forces on the opposite sides of the wheel sets. As a result, stability is maintained no matter how fast the vehicle travels and thus especially high vehicle speeds are tolerable.

Figure 2:
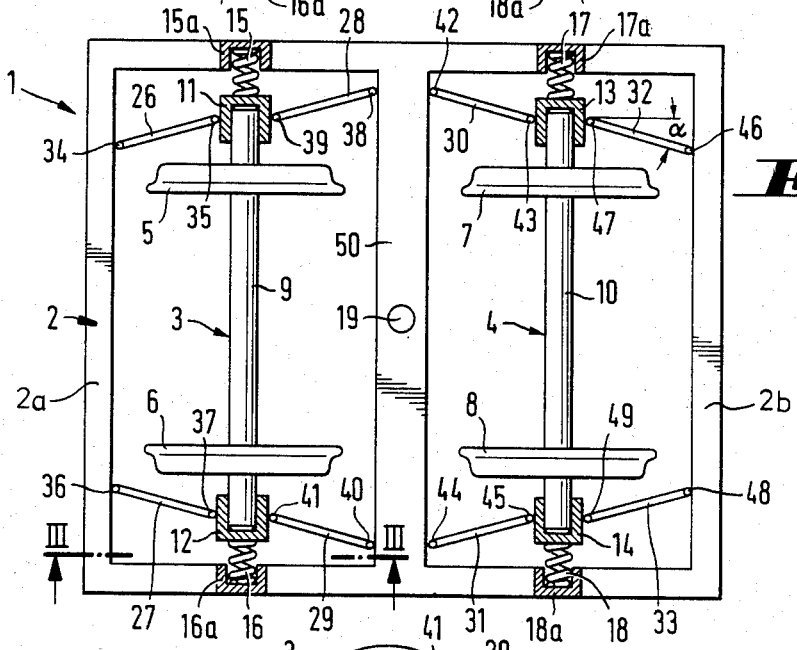
FIG. 2 is a view similar to FIG. 1 showing the guide structure for effecting this pattern of movement.

FIG. 2 shows the same bogie or wheel truck 1 in a somewhat simplified form but wherein the guide structure for the wheel sets has been shown in detail.

This guide structure is formed by oppositely oriented sets of links 26, 27, 28, 29, 30, 31, 32, 33 which are pivotally connected at one end to the frame 2. The pivot points are represented at 34–49.

The pivot points 34–37 and 46–49 lie in one horizontal plane while the pivot points 38–45 lie in a second horizontal plane spaced above the first vertical plane. All of the links are horizontal and are oriented to define isosceles trapezoids in the respective linkages.

More particularly, the pivots 34, 35, 36, 37 define the vertices of one trapezoid, the pivots 38, 39, 40, 41 define the vertices of a second trapezoid, the pivots 42, 43, 44,

45 define the vertices of a third trapezoid and the pivots 46, 47, 48, 49 define the vertices of a fourth trapezoid.

The links of the trapezoids are inclined at angles $\alpha$ to perpendiculars to the long bases of the trapezoid as shown in FIG. 2, the angle $\alpha$ being preferably between 5° and 15°.

For the outer trapezoids, the long bases are formed by the shafts 9 and 10.

For the inner trapezoids, however, the long bases are formed by the center limb 50 of the frame.

This arrangement thus results in the aforedescribed arcuate movement of the wheel sets 3 and 4 about the pivot axis 19.

Figure 4:
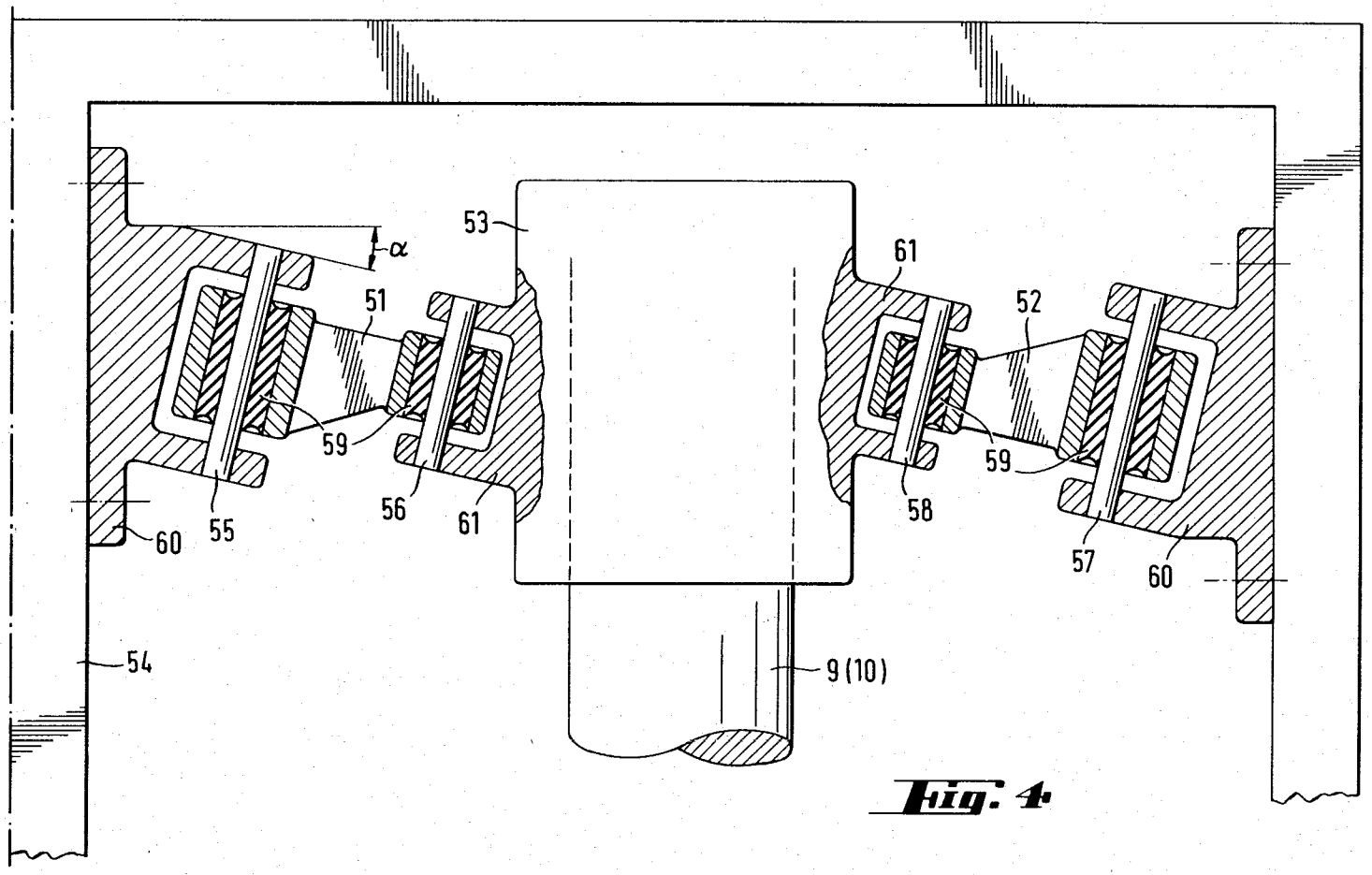
FIG. 4 is a detail view from above of structure for mounting a bearing of an axle for a wheel set according to the invention, with portions broken away.

FIG. 4 illustrates a detail of a suspension for the bearing assembly 53 of one of the axles 9 or 10 in a frame 54. Here the links 51 and 52 are swingable about pins 55–58 and are oriented with the inclination $\alpha$ previously described. Between each pin 55, 56, 57, 58 and each link 51 or 52 is provided a so-called "silentblock" 59, i.e. an elastomeric sleeve vulcanized to the eye of the link and to the pin. The pins are journaled, in turn, in bearing brackets 60 on the frame 54 and in brackets 61 formed on the bearing member 53.

Figure 3:
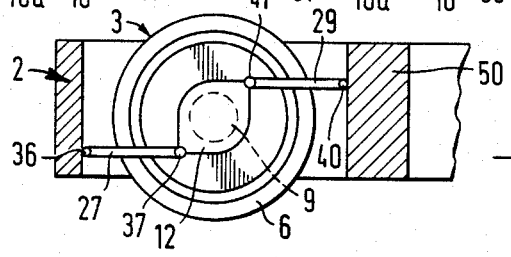
FIG. 3 is a diagrammatic section taken along the line III—III of FIG. 2.
Figure 5:
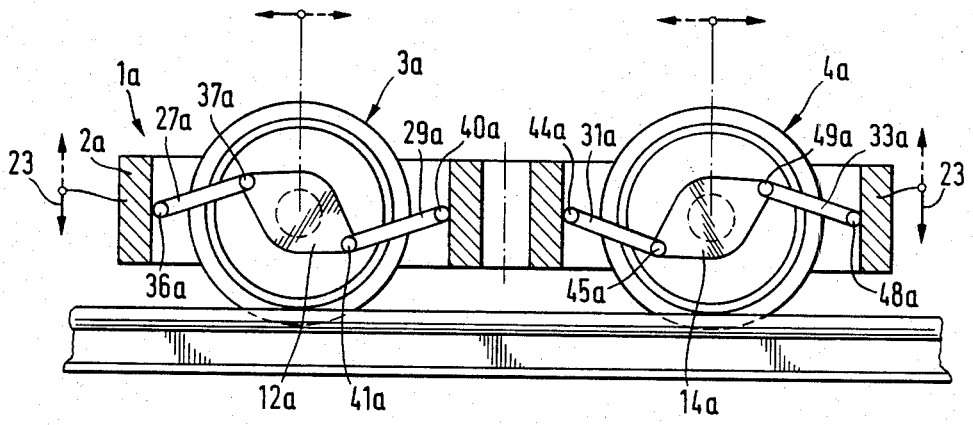
FIG. 5 is a vertical section through another embodiment of the invention, also in diagrammatic form.

FIG. 5 shows a somewhat different orientation of the links (compare FIG. 3) wherein the links are inclined to horizontal planes as well.

In this embodiment the links 27*a*, 29*a*, 31*a* and 33*a* are pivotally connected to the frame at the pivots 36*a*, 40*a*, 44*a* and 48*a* all in one horizontal plane.

The pivots 37*a*, 41*a*, 45*a* and 49*a* to the bearing blocks 12*a* and 14*a*, however, are offset from this horizontal plane. More particularly, the pivots 37*a* and 49*a* lie in a horizontal plane above the median plane of the pivots 36*a*, 40*a*, 44*a* and 48*a* while the pivots 41*a* and 45*a* lie below this latter plane.

Preferably the links are provided mirror-symmetrically about a plane perpendicular to the plane of the paper and midway between the wheel sets and a plane parallel to the plane of the paper median between the wheels of both sets.

The mirror-symmetrical relationship shown in FIG. 5 has been found to be especially effective when the truck is subject to rolling movement as represented by the arrows 23 in FIG. 5 such that on a downward movement the wheel sets tend to move toward one another, and then on an upward movement the wheel sets tend to move apart. Conversely, when the frame tends to move downwardly relative to the wheel sets, they tend to move apart.

We claim:

1. A bogie for a railway vehicle, comprising:

a frame pivotally mounted on said vehicle for angular displacement about an upright pivot axis relative to said vehicle, said frame having a central bar in a vertical plane of said pivot axis and a pair of outer limbs parallel to said bar and disposed on opposite sides therein in a spaced relation to said bar;

a pair of wheel sets disposed on opposite sides of said axis in said frame between said bar and respective ones of said limbs, each of said wheel sets comprising a pair of wheels engaging respective rails of a railroad track, a shaft interconnecting said wheels, and respective bearing blocks engaging the ends of said shafts for journaling said wheel sets in said frame;

resilient means interposed between said frame and said wheel sets for enabling lateral axial displacement of said wheel sets in said frame; and respective guide means between said frame and said wheel sets for guiding said wheel sets on said frame, each of said guide means including a trapezoidal linkage having said bar as a broad base thereof and links converging away from said bar toward said limb, said links of each trapezoidal linkage including first links pivotally connected to said bar and to the bearing blocks of the respective wheel sets and converging toward the respective limb and second links pivotally connected to the respective bearing bars and to the respective limb and converging toward said limb with the same angle of convergence of said first links, the pivots of said links to the respective bearing block being vertically offset.

2. The bogie defined in claim 1 wherein at least one of the two pivots of each of said links is resilient.

3. The bogie defined in claim 1, further comprising lateral springs braced between each of said bearing blocks and said frame.

4. The bogie defined in claim 1 wherein said first links lie in one horizontal plane and said second links lie in another horizontal plane.

5. The bogie defined in claim 1 wherein the pivots of those links which connect the bearing blocks to said limbs are disposed at a higher level at said bearing blocks than the pivots at the bearing blocks of those links connecting the bearing blocks to said bar.

6. The bogie defined in claim 5 wherein the pivots connecting said links to said bar and to said limbs lie in a common horizontal plane between said levels.

* * * * *